US005289816A

United States Patent [19]

Rakowski

[11] Patent Number: 5,289,816

[45] Date of Patent: Mar. 1, 1994

[54] HYDRAULIC RAM RETRACTION PILE CUTTER

[76] Inventor: Frederick M. Rakowski, Box 17, Group 503, RR 5, Winnipeg, Manitoba, Canada, R2C 2Z2

[21] Appl. No.: 965,807

[22] Filed: Oct. 23, 1992

[51] Int. Cl.[5] ..... B28D 1/32

[52] U.S. Cl. ..... 125/23.01; 405/232; 405/303

[58] Field of Search ..... 405/231, 232, 303; 125/23.01, 36, 40; 83/694

[56] References Cited

U.S. PATENT DOCUMENTS 4,124,015 11/1978 Isaksson ..... 125/23
4,197,828 4/1980 Schellhorn ..... 125/23
4,261,399 4/1981 Hawkins et al. ..... 144/34
4,480,627 11/1984 van der Toorn ..... 125/23
4,880,335 11/1989 Lee ..... 405/158
4,979,489 12/1990 Abbasov et al. ..... 125/23.01
5,025,803 6/1991 van der Toorn ..... 125/23.01

*Primary Examiner*—David H. Corbin
*Attorney, Agent, or Firm*—Palmatier, Sjoquist & Helget

[57] ABSTRACT

A pile cutter for breaking up reinforced concrete piles. The pile cutter includes a pair of hydraulic cylinders which operate cutting teeth when the hydraulic rams are retracted. The use of only two cylinders, and the cutting of the pile when the rams are retracted minimize the weight of the pile cutter and the space occupied by such.

6 Claims, 3 Drawing Sheets

HYDRAULIC RAM RETRACTION PILE CUTTER

BACKGROUND OF THE INVENTION

The present invention relates to pile cutters and, more particularly, to pile cutters which include hydraulic rams for cutting and crushing concrete piles when the hydraulic rams are retracted.

A pile is a massive beam of reinforced concrete set deeply in the earth's crust as support for a structure. A pile cluster is a set of piles driven into the earth relatively closely together. Initially, the top portions of the adjacent piles may be uneven with respect to each other. Pile cutters are used to top, by way of crushing or cutting, the upper portion of the piles such that a pile cap may be suitably placed on the pile cluster.

SUMMARY OF THE INVENTION

An object of the present invention is to minimize the weight of a pile cutter.

Another object of the present invention is to minimize the space occupied by a pile cutter.

A feature of the present invention is the provision in a pile cutter having a ram and cylinder mechanism for operating breaking means for cutting and crushing the pile, of the breaking means engaging the pile when the ram is drawn into the cylinder.

Another feature is the provision in such a pile cutter, of a pair of ram and cylinder mechanisms disposed on either of the sides of the pile and between a pair of the breaking means for cutting and crushing such that weight and space are conserved while the pile is engaged from opposite sides.

Another feature of the provision in such a pile cutter, of means for equalizing the pressure exerted by the breaking means on either of the sides of the pie.

Another feature is the provision in such a pile cutter, of the breaking means having a set of teeth tailored to fit the pile, the set of teeth having extended outer teeth and shorter inner teeth.

An advantage of the present invention is that the weight of the pile cutter is minimized.

Another advantage is that the space occupied by the pile cutter is minimized.

Another advantage is that piles are broken cleanly and efficiently. The cutting and crushing of the top of the pile, generally referred to as breaking, is performed cleanly by the present pile cutter such that finishing touches to the top of the pile by a jackhammer are minimized.

Another advantage is that the present pile cutter is simple and inexpensive to fabricate, operate, and maintain.

DETAILED DESCRIPTION OF THE PREFERRED EMBODIMENTS

Figure 1:
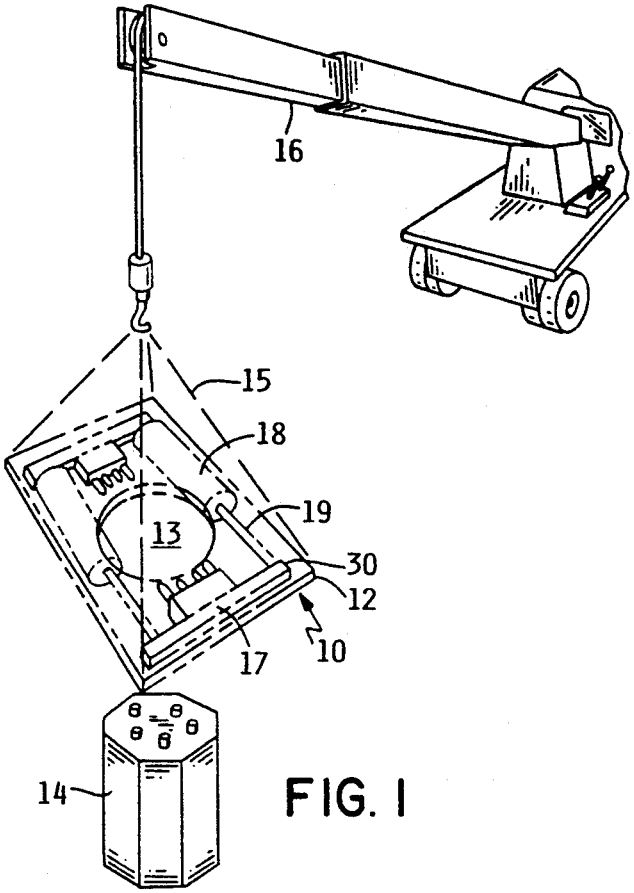
FIG. 1 is an environmental, schematic view of the present pile cutter shown in relation to a reinforced concrete pile and a crane for lifting the pile cutter.

The present pile cutter is indicated in general by the reference numeral 10. It includes a frame 11 with a base portion 12 which includes a circular pile opening 13 formed therein for receiving a pre-cast reinforced concrete pile 14. The pile cutter 10 is typically suspended by chain or cable elements 15 from a crane 16. The pile 14 is crushed or cut by operation of a crushing and cutting or breaking mechanism 17 engaging the pile 14 when the cylinder mechanisms 18 draw in their respective rams 19.

With more specificity, the base portion 12 of the frame 11 is generally a square steel plate with the pile opening 13 formed centrally therein. The frame 11 further includes a pair of angle irons 20 rigidly mounted, such as by welding, on the base portion 12 and extending thereacross in parallel fashion on either of the sides of the pile opening 13. Each of the ends 21 of each of the angle irons 20 includes a vertical end plate 22 welded thereto as well as to the base portion 12. A bar 23 is rigidly affixed, such as by welding, between each of the opposing ends 21 of the angle irons 20 to lend lateral support to and between the angle irons 20.

Each of the angle irons 20 further includes a pair of vertical guide ribs 24 rigidly fixed, such as by welding, to the angle iron 20 and base portion 12 adjacent to the pile opening 13 to engage the pile 14. Each of the ribs 24 may be aligned with or spaced immediately outwardly of the circle defined by the pile opening 13 to guide the pile cutter 10 as it is lowered about the pile 14.

Each of the angle irons 20 further includes a pair of windows 25 through which the crushing and cutting mechanisms 17 extend laterally and in which the crushing and cutting mechanisms 17 are extended and retracted longitudinally by virtue of the cylinder mechanisms 18. Each of the windows 25 is formed in part by respective inner and outer vertical edges or stops 26, 27. Each of the angle irons 20 further includes a pair of lifting eyes 28 for engaging the elements 15 for handling and placing of the pile cutter 10.

The cutting and crushing mechanism 17, generally referred to as breaking means 17, includes cross-head beams 30 which are drawn toward each other by retraction of the rams 19. Each of the beams 30 carry a set of cutting teeth 31 for cutting and crushing the pile 14. Each of the cross-head beams 30 includes upper and lower parallel plate sections 32, 33 and inner and outer parallel plate sections 34, 35. At each of its end portions 36, each of the beams 30 include upper and lower mounting flanges 37, 38 which extend integrally from the upper and lower beam plate sections 32, 33 and which mount the rams 19 and cylinder mechanisms 18.

Each of the cross-head beams 30 is rigidly mounted, such as by welding, on a base plate 40, which in turn slidably engages the frame base portion 12. Each of the base plates 40 includes a pair of linear, parallel channels 41 for engaging linear, parallel respective guide rails 42, which are rigidly mounted on the frame base portion 12 and which maintain alignment of the cross-head beams 30 when the beams 30 are drawn toward one another by the rams 19 and cylinder mechanisms 18.

To account for various sizes of the concrete piles 14, which may be substantially equal to or less than the diameter of the pile opening 13, each of the sets of teeth 31 is adjustable toward or away from the opening 13 via a telescoping arm and sleeve mechanism 50. Each of the mechanisms 50 include a sleeve 51 extending through and fixed to its respective beam 30. A beam arm 52 is slidably engaged in each of the sleeves 51. At their inner ends, each of the arms 52 is rigidly secured, such as by welding, to a tooth mounting vertical plate 53 which includes a plurality of sockets 54 for removably and replaceably mounting the cutting teeth 31. At their outer ends, each of the telescoping arm and sleeve mechanisms 50 includes a pin 55 for interlocking the arm 52 and sleeve 51 for setting the teeth 31 a prescribed distance from the pile 14. Removal of the pin 55 permits the arm 52 and the tooth mounting plate 53 to be drawn toward and away from the pile opening 13. To fix the arm 52 and hence fix the teeth 31 a prescribed distance from the pile opening 13, the pin 55 is engaged with the arm 52 and one or more removable spaced shims 57 are placed between the tooth mounting plate 53 and the cross-head beam 30. It should be noted that the base plate 40 includes a front, stepped, lower floor 58 which engages the shims 57 and tooth mounting plate 53. Each of the shims 57 includes a handle 58.

Figure 7:
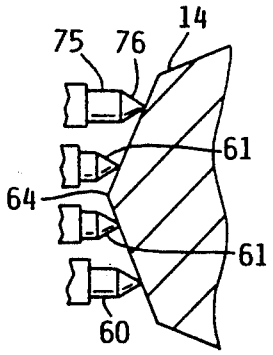
FIG. 7 is a detailed, partial view of the teeth of the pile cutter of FIG. 2 engaging the reinforced concrete pile.
Figure 3:
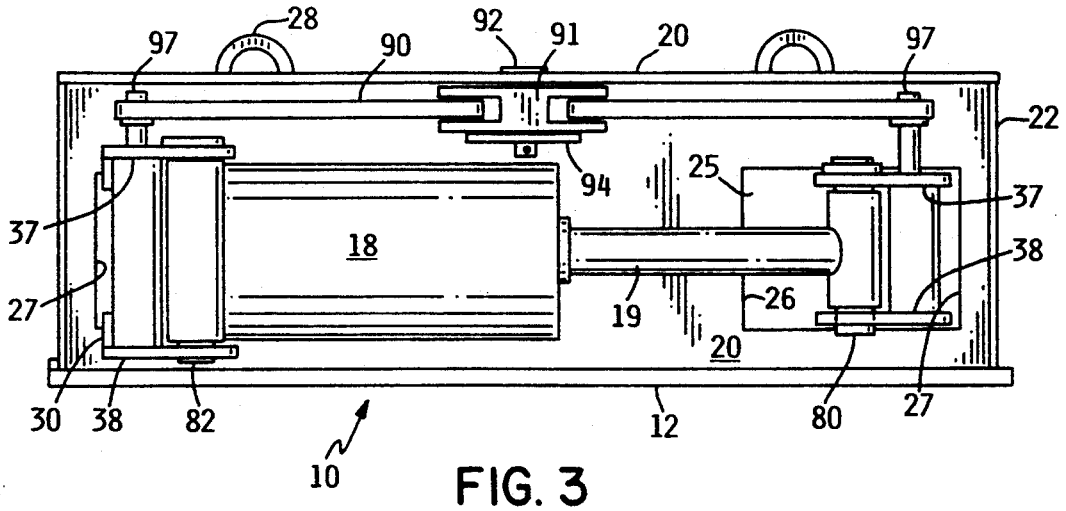
FIG. 3 is a side elvation view of the pile cutter of FIG. 2.
Figure 2:
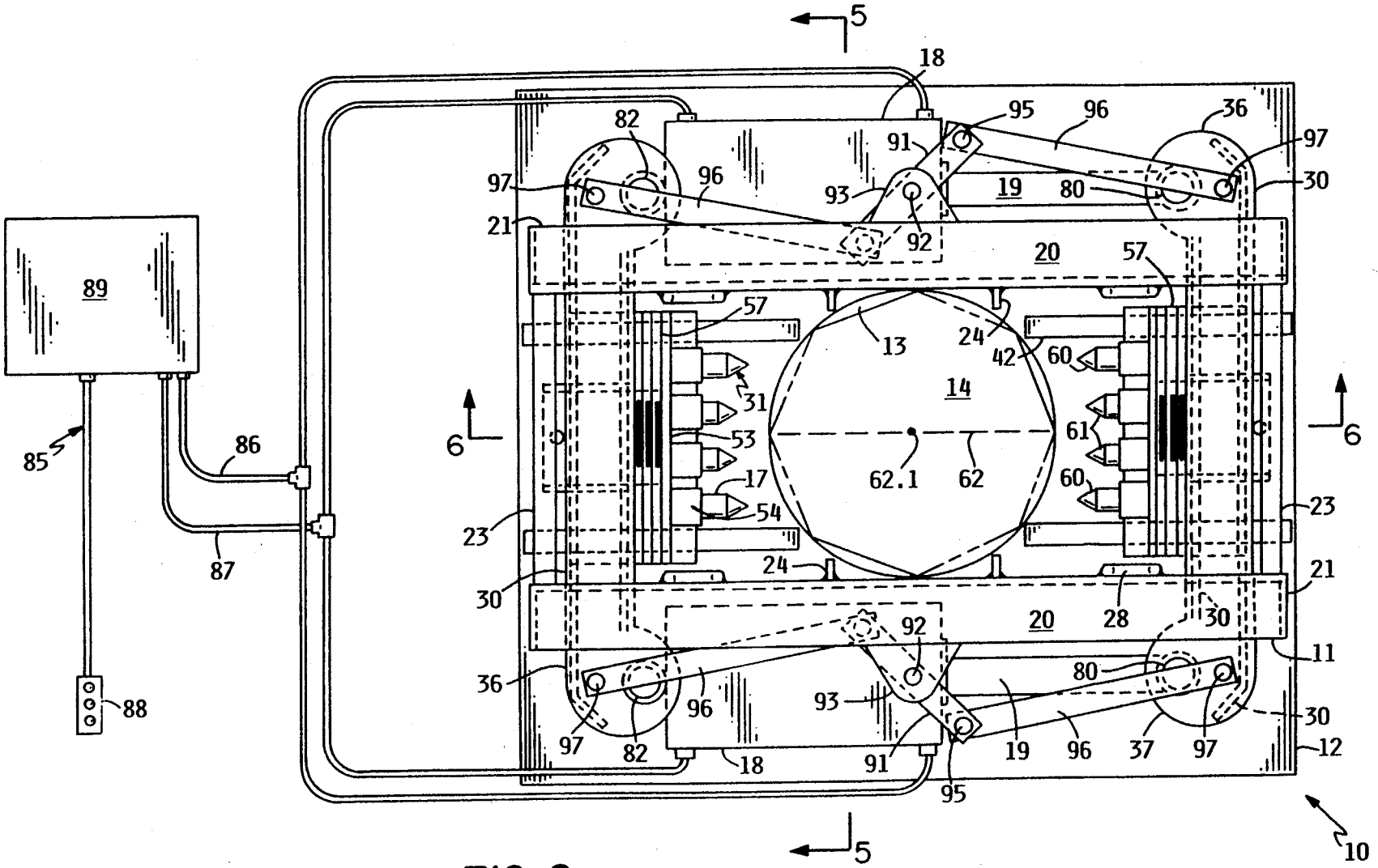
FIG. 2 is a detail, top, partially phantom and schematic view of the pile cutter of FIG. 1.
Figure 4:
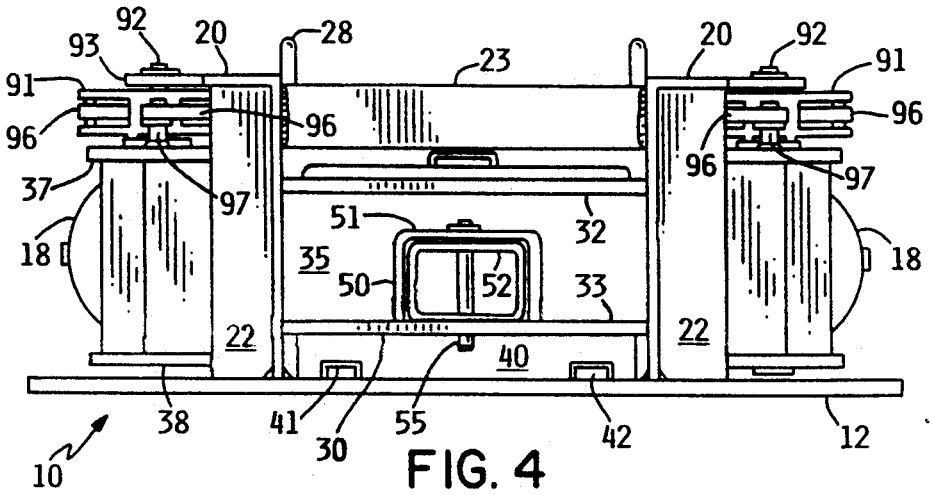
FIG. 4 is an end elevation view of the pile cutter of FIG. 2.
Figure 5:
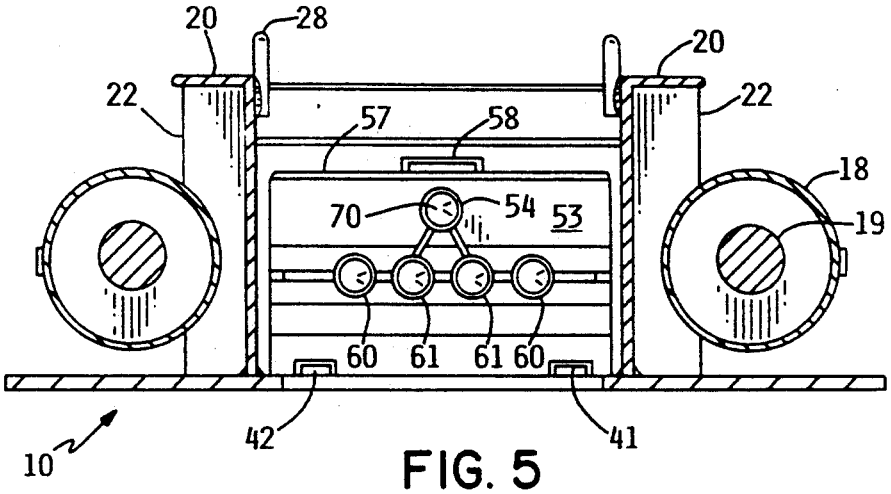
FIG. 5 is a section view at lines 5—5 of FIG. 2.
Figure 6:
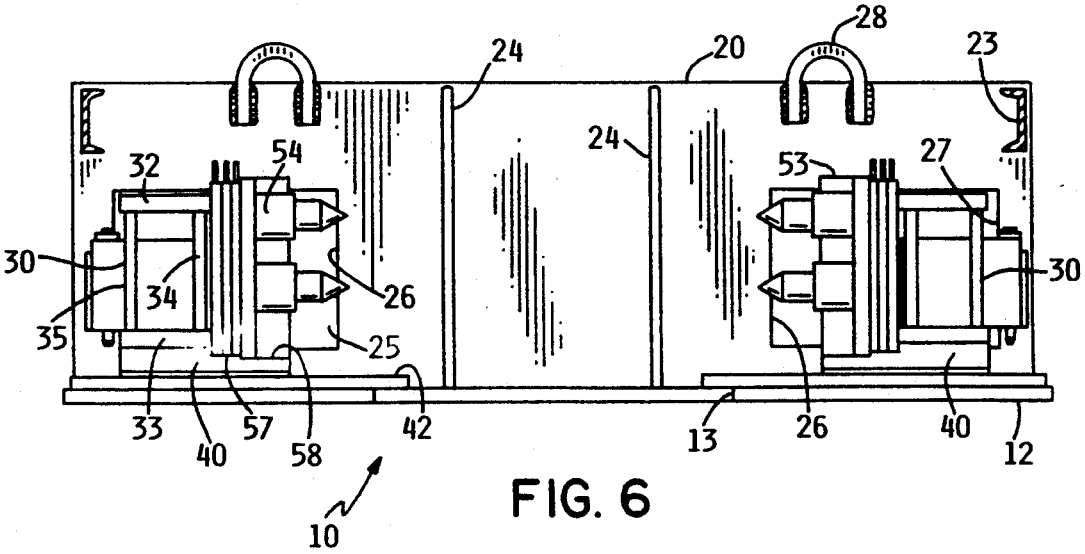
FIG. 6 is a section view at lines 6—6 of FIG. 2.

Each of the sets of teeth 31 typically includes a pair of two longer outer teeth 60 and a pair of shorter inner teeth 61. The teeth 60, 61 are typically used for cracking a pile. The teeth 60, 61 lie in the same plane. The inner teeth 61 lie on parallel lines which are spaced equidistant from a line 62 which intersects the center 62.1 of the pile opening 13 and which lies normal to the vertical axis of the pile 14. When engaged with an octagon-shaped pile 63 to crack the pile 63, as shown in FIG. 7, it is preferred that the inner teeth 61 engage the pile adjacent to one of the corners 64 which intersects line 62. The longer outer teeth 60 are of a prescribed length to engage the pile 63 at the same point in time that the pile 63 is engaged by the inner teeth 61.

Each of the sets of teeth 31 further include an upper tooth 70 for use, along with the four lower teeth 60, 61, for crushing a cracked pile. The upper tooth 70 is also removable and replaceable. After a pile has been cracked with the four lower teeth 60, 61, the pile cutter 10 is raised to the top of the pile, where the upper tooth 70 is added to the teeth 60, 61. The pile cutter 10 is then lowered to the cracked pile portion to crush the pile.

Each of the teeth 60, 61, 70 includes a cylindrical body 75 and a conical tip 76. Each of the teeth 60, 61, 70 is removably disposed in one of the plurality of cylindrical sockets 54 formed in the tooth mounting plate 53. Each of the sockets 54 extends relatively deeply in its respective plate 53 to stably engage the teeth 60, 61, 70. The tip 76 of one of the inner teeth 61 and the tip 76 of its adjacent outer tooth 60 define a line, and the tips 76 of the other outer and inner teeth 60, 61 define another line. Such lines intersect and lie in places defined by the faces of the octagonal pile 14.

The ram 19 of each of the respective cylinder mechanisms 18 is pivotally affixed via a pivot pin 80 to one of the cross-head beams 30. Each of the cylinder mechanisms 18 is pivotally affixed via a pivot pin 82 to the other cross-head beam 30. Each of the pivot pins 80, 82 engages its respective upper and lower flanges 37, 38 of the ends 36 of the cross-head beams 30.

The rams 19 and cylinder mechanism 18 are controlled by a hydraulic control system 85 which includes hydraulic lines 86, 87, a stop-in-out remote control unit 88, and a separate wet kit 89.

An equalizing means 90 for equalizing pressure exerted by each of the sets 31 of teeth against the pile 14 is disposed between the angle irons 20 and the cross-head beams 30. Each of the equalizing means 90 includes a pivot arm or equalizer 91 pivotally mounted via a pin 92 between upper and lower triangular like flanges 93, 94 which are rigidly affixed to and extend from their respective angle irons 20. At each of their ends, each of the pivot arms 91 is pivotally connected via a pin 95 to an end of a tie rod 96. Each of the tie rods 96 extends from its respective pivot arm 91 to one of the ends 36 of one of the cross-head beams 30 to which such tie rod 96 is pivotally affixed by a pivot pin 97. Pivot arms 91 and their respective tie rods 96 permit each of the cross-head beams 30 to be retracted or extended only as far as its opposing beam 30 is extended or retracted. Hence, the pressure exerted by the teeth 31 of one of the beams 30 on the pile 14 is the same as the pressure exerted by the teeth 31 of the other beam 30.

In operation, the pile cutter 10 is connected to the chain or cable elements 15 to be suspended from an apparatus such as the crane 16, and is then inserted over the top of the reinforced concrete pile 14. Subsequently, with the four lower cracking teeth 60, 61 fixed into their respective sockets 54 and the upper crushing tooth 70 absent from its respective socket 54, the pile cutter 10 is lowered to a predefined height at which the pile 14 is to be cracked. The rams 19 and cylinder mechanisms 18 are then operated to retract the rams 19 to draw in the cross-head beams 30 such that the teeth 60, 61 engage and crack the pile 14. The rams 19 are drawn in until the pile 14 is sufficiently cracked or until the beams 30 engage the inner edges or stops 26 of the windows 25. The rams 19 are then extendable until the tips 76 of the teeth 60, 61 are spaced sufficiently from the pile 14, or until the tips 76 are disposed outwardly of the circle defined by the pile opening 13, or until the beams 30 engage the outer edges 27 of the windows 25, or until the beams 30 are extended anywhere therebetween to an extension suitable to the operator. During such extension and retraction, the teeth 60, 61 are maintained at a precise distance from the center 62.1 of the pile opening 13 and hence an equal pressure is exerted on either of the sides of the pile 14 during retraction of the rams 19.

After the pile 14 has been cracked, the upper teeth 70 are placed in their respective sockets 54 and the rams 19 are again retracted to draw in the cross-head beams 30 such that the teeth 60, 61, and 70 engage and crush the pile 14 where the pile 14 was previously cracked to expose the reinforcing rods to prep the pile 14 for placement of a pile cap thereupon.

It should be noted that, if desired, the windows 25 may extend downwardly to the base portion 12 such that portions of the cross-head beams 30 and portions of the cylinder mechanisms 18 slidably engage the base portion 12 during extension and retraction of the rams 19.

The present invention may be embodied in other specific forms without departing from the spirit or essential attributes thereof, and it is therefore desired that the present embodiment be considred in all respects as illustrative and not restrictive, reference being made to the appended claims rather than to the foregoing description to indicate the scope of the invention.

What is claimed is:

1. A compact pile cutter for breaking up concrete piles, comprising:

a) a frame having an opening for receiving a pile therein;

b) a pair of breaking means with opposite ends, the breaking means being movably mounted on the frame for engaging opposite sides of the pile for breaking up the pile;

c) a pair of parallel ram and cylinder mechanisms connected to and disposed between the pair of breaking means wherein the drawing in of the rams into the cylinders draws the breaking means toward each other to engage and break up the pile when the rams are drawn in; and d) a pair of parallel mechanical equalizing means on the frame, wherein the equalizing means each comprises a pivot mechanism disposed on the frame on either side of the opening and between the breaking means, each of the pivot mechanisms comprising a pivot arm pivotally connected to the frame and having pivot arm opposite ends and a pair of extension arms, each of the extension arms pivotally connected between one of the pivot arm opposite ends and one of the breaking means opposite ends.

2. The pile cutter of claim 1, wherein the ram of one mechanism is connected to one breaking means and the cylinder of such mechanism is connected to the other breaking means such that the cylinders move relative to the frame when the rams are operated to draw the breaking means toward each other.

3. A compact pile cutter for breaking up concrete piles, comprising:

a) a frame having an opening for receiving a pile therein;

b) a pair of movable breaking means on the frame opposing each other with the opening therebetween for engaging the pile for breaking up the pile, each breaking means having two distal end portions; and c) a pair of parallel ram and cylinder mechanisms mounted on the frame opposing each other with the opening therebetween, each ram and cylinder mechanism engaging one opposing distal end of each breaking means as to draw the breaking means to the pile to break up the pile when the rams are drawn in; and d) a pair of equalizing means wherein each comprises a pivot mechanism disposed on the frame on either side of the opening and between the breaking means, each of the pivot mechanisms comprising a pivot arm pivotally connected to the frame and having opposite ends and a pair of extension arms, each of the extension arms pivotally connected between one of the opposite ends and one of the distal ends of the breaking means.

4. The pile cutter of claim 3, wherein each of the breaking means including one set of the four teeth, one tooth of each of the sets being linearly aligned with another tooth from the other set.

5. The pile cutter of claim 3, and the pile being octagonal in section to have eight faces, wherein each of the teeth includes a tip, the tips of one of the inner teeth and its adjacent outer tooth defining a line, the tips of the other inner and outer teeth defining a line, the lines intersecting and lying in planes defined by two adjacent faces of the octagonal pile whereby the inner and outer teeth engage the pile simultaneously.

6. A pile cutter for breaking up concrete piles, comprising:

a) a frame having an opening for receiving a pile therein;

b) a pair of breaking means slidable on the frame opposing each other with the opening therebetween for engaging opposite sides of the pile for breaking up the pile, the breaking means each being slidable to and away from the opening, each of the breaking means including a set of teeth for engaging the pile;

c) a pair of parallel ram and cylinder mechanisms opposing each other with the opening therebetween for drawing the breaking means toward each other to engage and break up the pile when the rams are drawn in, the rams of the mechanisms being connected to one of the breaking means and the cylinders of the mechanisms being connected to the other breaking means, the rams of the mechanisms retracting in the same direction;

d) a set of teeth on each breaking means for engaging the pile, the teeth being disposed in a horizontal plane, each set having a pair of outer two teeth extending beyond a pair of inner two teeth, the outer two teeth having the same length and the inner two teeth having the same length, the inner and outer teeth of one set extending in the same linear direction as the inner and outer teeth of the other set; and e) mechanical equalizing means on the frame for equalizing pressure exerted by each of the breaking means against the pile, wherein the equalizing means comprises a pivot mechanism disposed on the frame on either side of the opening and between the breaking means, each of the pivot mechanisms comprising a pivot arm pivotally connected to the frame and having opposite ends and a pair of extension arms, each of the extension arms pivotally connected between one of the opposite ends and one of the breaking means.

* * * * *